US009437112B1

(12) United States Patent
Greene

(10) Patent No.: US 9,437,112 B1
(45) Date of Patent: Sep. 6, 2016

(54) DEPICTION OF RELATIVE MOTION OF AIR TRAFFIC VIA AN AIR TRAFFIC DISPLAY

(71) Applicant: Philip A. Greene, Salem, OR (US)

(72) Inventor: Philip A. Greene, Salem, OR (US)

(73) Assignee: Garmin International, Inc., Olathe, KS (US)

( * ) Notice: Subject to any disclaimer, the term of this patent is extended or adjusted under 35 U.S.C. 154(b) by 0 days.

(21) Appl. No.: 14/737,260

(22) Filed: Jun. 11, 2015

(51) Int. Cl.
*G05G 5/00* (2006.01)
*G08G 5/00* (2006.01)

(52) U.S. Cl.
CPC ..... *G08G 5/0021* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,735,408 | A | 5/1973 | Litchford | 341/112 |
| 3,737,902 | A | 6/1973 | O'Hagan et al. | 342/41 |
| 4,274,096 | A * | 6/1981 | Dennison | G01S 13/9303 342/456 |
| 4,313,115 | A | 1/1982 | O'Sullivan | 343/5 |
| 6,161,097 | A | 12/2000 | Glass et al. | 705/6 |
| 6,249,241 | B1 | 6/2001 | Jordan et al. | 342/41 |
| 6,469,660 | B1 | 10/2002 | Horvath et al. | 342/179 |
| 6,473,003 | B2 | 10/2002 | Horvath et al. | 340/945 |
| 6,542,809 | B2 * | 4/2003 | Hehls, III | G01S 7/22 342/36 |
| 6,564,149 | B2 | 5/2003 | Lai | 701/301 |
| 6,567,037 | B1 * | 5/2003 | Fung | G01S 13/91 342/29 |
| 6,594,578 | B2 | 7/2003 | Lai | 701/120 |
| 6,826,458 | B2 | 11/2004 | Horvath et al. | 701/3 |
| 6,957,130 | B1 | 10/2005 | Horvath et al. | 701/3 |
| 6,970,104 | B2 | 11/2005 | Knecht et al. | 340/945 |
| 7,124,000 | B2 | 10/2006 | Horvath et al. | 701/3 |
| 7,382,285 | B2 | 6/2008 | Horvath et al. | 340/961 |
| 7,696,904 | B2 | 4/2010 | Horvath et al. | 340/961 |
| 2004/0095259 | A1 | 5/2004 | Watson | 340/945 |
| 2013/0093612 | A1 | 4/2013 | Pschierer et al. | 342/36 |

OTHER PUBLICATIONS

U.S. Appl. No. 13/475,666, filed May 18, 2012 entitled Depiction of Relative Motion of Air Traffic Via an Air Traffic Display.

* cited by examiner

*Primary Examiner* — Thomas Tarcza
*Assistant Examiner* — Edward J Pipala
(74) *Attorney, Agent, or Firm* — Samuel M. Korte; Max M. Ali

(57) ABSTRACT

Techniques are described that allow an air traffic display of an aircraft to display the relative motion of air traffic proximate to the aircraft. The air traffic display may be switched between a first display mode in which absolute motion of air traffic is displayed (e.g., motion of air traffic targets relative to a fixed point on the earth's surface or relative to an apparently fixed celestial point is displayed) and a second display mode in which motion of air traffic targets is displayed relative to the aircraft. The techniques further facilitate the selection of individual traffic targets from a displayed traffic depiction to activate a third display mode in which additional information about the relative motion of the selected target, such as its estimated closest point of approach (CPA) to the aircraft and the estimated time it will take the selected target to reach the CPA are shown.

13 Claims, 9 Drawing Sheets

DEPICTION OF RELATIVE MOTION OF AIR TRAFFIC VIA AN AIR TRAFFIC DISPLAY

CROSS-REFERENCE TO RELATED APPLICATIONS

The present application is a continuation of, and claims priority benefit to, co-pending and commonly assigned U.S. patent application entitled "DEPICTION OF RELATIVE MOTION OF AIR TRAFFIC VIA AN AIR TRAFFIC DISPLAY," application Ser. No. 13/475,666, filed May 18, 2012, which is herein incorporated by reference in its entirety.

BACKGROUND

Integrated avionics systems may include one or more electronic displays for displaying primary flight information such as attitude, altitude, heading, vertical speed, and so forth, to the pilot. For instance, integrated avionics systems may include one or more primary flight displays (PFD) and one or more multifunction displays (MFD). A representative PFD may display primary flight and selected navigation information that is typically received from one or more sensor systems such as an attitude heading reference system (AHRS), an inertial navigation system (INS), one or more air data computers (ADC) and/or navigation sensors. A representative MFD may display information for navigation and for broad situational awareness such as navigation routes, flight plans, information about aids to navigation (including airports), moving maps, weather information, terrain and obstacle information, traffic information, engine and other aircraft systems information, and so forth.

Some integrated avionics systems provide air traffic displays that are configured to display depictions of air traffic within the airspace surrounding the aircraft. In some systems, air traffic displays can display depictions of air traffic that are generated based upon data obtained from multiple air traffic detection systems, such as Traffic Collision Alerting Device (TCAD) systems, Traffic Collision Avoidance System (TCAS), Automatic Dependent Surveillance-Broadcast (ADS-B) systems, Automatic Dependent Surveillance-Re-broadcast (ADS-R) systems and Traffic Information Services-Broadcast (TIS-B) systems. In this manner, air traffic displays can be furnished that provide flight crew members with a detailed, accurate and real-time depiction of air traffic in the vicinity of the aircraft.

SUMMARY

Techniques are described that allow an air traffic display of an aircraft to display the relative motion of air traffic proximate to (e.g., within a monitored airspace around) the aircraft. In one or more implementations, the air traffic display may be switched between a first display mode in which absolute motion of air traffic is displayed (e.g., motion of air traffic targets relative to a fixed point on the earth's surface or relative to an apparently fixed celestial point is displayed) and a second display mode in which motion of air traffic targets is displayed relative to the aircraft. The techniques further facilitate the selection of one or more individual traffic targets from a displayed traffic depiction to activate a third display mode in which additional information about the relative motion of a selected target, such as its estimated closest point of approach (CPA) to the aircraft and the estimated time for it to reach the CPA are shown. The techniques may be implemented by an independent avionics unit, one or more avionics units within an integrated avionics system of the aircraft, a stand-alone air traffic display unit, and so forth.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWING FIGURES

The detailed description is described with reference to the accompanying figures. The use of the same reference numbers in different instances in the description and the figures may indicate similar or identical items.

Figure 1:
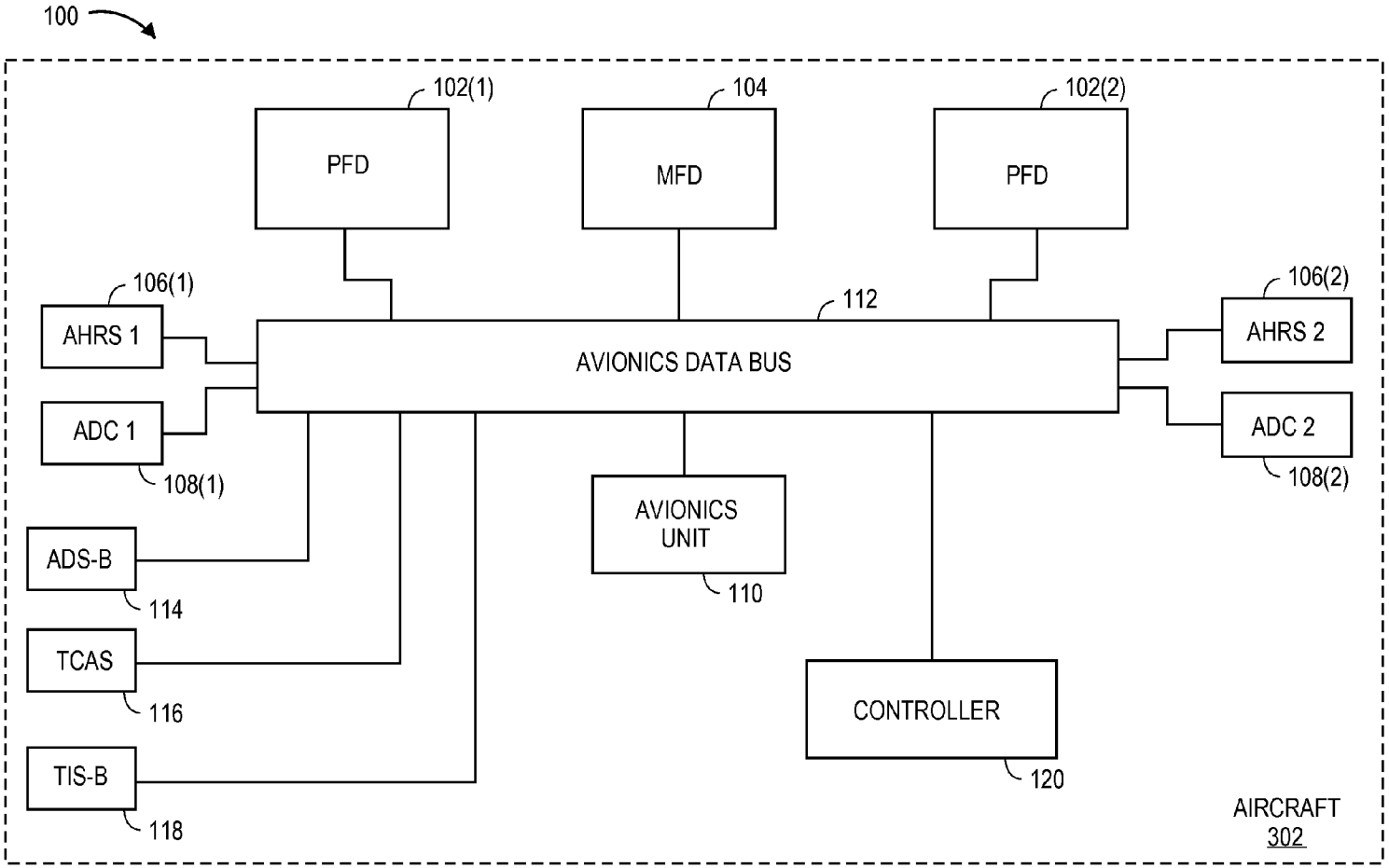
FIG. 1 is a block diagram illustrating an environment in an example implementation that includes an integrated avionics system configured to provide an air traffic display in accordance with the present disclosure.

The drawing figures do not limit the system to the specific implementations disclosed and described herein. The drawings are not necessarily to scale, emphasis instead being placed upon clearly illustrating elements of the system.

DETAILED DESCRIPTION

Overview

Currently, airborne air traffic displays show directionality information (e.g., heading, position, threat level, etc.) for air traffic targets that is based upon data which measures how those air traffic targets are moving relative to the ground (e.g., ground-based track data, ground track data, ground track, true track, etc.). Consequently, to determine if the displayed air traffic targets may pose a threat of collision with the aircraft, the flight crew must monitor the changing position of the targets to determine whether the air traffic targets are moving toward the aircraft or away from the aircraft. For example, a pilot may periodically monitor the position of an air traffic target within an air traffic display to determine whether the air traffic target is moving left to right or right to left across the air traffic display or downward on the air traffic display. The pilot may determine whether the air traffic target poses a threat of colliding with the aircraft based on the current position of the air traffic target, its direction of travel (e.g., heading), and its speed. If the current position, direction of travel, and speed of the air traffic target overlap or intersect with a future position of the aircraft, the target could potentially pose a threat of collision. Flight crew members therefore must spend time monitoring the air traffic display in an effort to identify air traffic target threats, rather than looking outside of the aircraft's cockpit (e.g., practicing "see and avoid" techniques) or focusing on other displays and instrumentation.

Accordingly, techniques are described that allow an air traffic display of an aircraft to display the relative motion of air traffic proximate to (e.g., within a monitored airspace around) the aircraft. In one or more implementations, the techniques may be implemented by (e.g., as one or more software modules executed by) an avionics unit, which may be part of an integrated avionics system of the aircraft (e.g., an integrated avionics unit (IAU)), display devices, one or more dedicated air traffic display units, a combination thereof, and so forth. The avionics unit is configured to cause a display device to furnish an air traffic display within the cockpit of the aircraft to be switched between a first display mode in which absolute motion of air traffic is displayed (e.g., motion of air traffic targets relative to a fixed point on the earth's surface or relative to an apparently fixed celestial point is displayed) and a second display mode in which motion of air traffic targets is displayed relative to the aircraft. The avionics unit may determine the relative motion of the one or more air traffic targets or receive information providing the relative motion of air traffic targets within a monitored airspace surrounding the aircraft. The avionics unit may further facilitate the selection of individual air traffic targets from a displayed traffic depiction to activate a third display mode in which additional information about the selected target, such as its estimated closest point of approach (CPA) to the aircraft and the estimated time it will take the selected target to reach the CPA are shown. The additional information may be profile information that may include relative motion information for the selected target. Thus, the avionics unit, amongst other functionality, can allow for leveraging of different presentations of air traffic to a flight crew.

The avionic unit may determine information about air traffic within a monitored airspace surrounding the aircraft and/or potential maneuvers for avoiding a collision with an air traffic target. In embodiments, the techniques described herein may employ vector mathematics, and may leverage data that is calculated for use in Conflict Situational Awareness (CSA) algorithms, to determine (e.g., infer or estimate) information about air traffic targets such as: direction of travel (track), speed, how close the targets may pass relative to the aircraft (e.g., Closest Point of Approach (CPA)), how long before a CPA will occur, potential maneuvers for increasing the distance of the CPA, and potential maneuvers for avoiding collision. Further, the techniques allow for air traffic display depictions to be displayed that show motion of each air traffic target (e.g., each of a plurality of other aircraft within a monitored airspace surrounding the aircraft) relative to the aircraft. Still further, the techniques allow a flight crew member (e.g., pilot or copilot) to selectively switch between a first display mode (in which absolute motion of air traffic is displayed) and a second display mode (in which motion of air traffic targets relative to aircraft is displayed) on an air traffic display (e.g., a Cockpit Display of Traffic Information (CDTI) display). The flight crew member may select individual traffic targets from a displayed traffic depiction to activate a third display mode (in which additional information about the selected target, such as its estimated CPA to the aircraft and the estimated time it will take the selected target to reach the CPA, are shown). The additional information may include profile information that may include relative motion information for the selected target. In some embodiments, the CPA for target aircraft may be displayed by the first display mode and/or the second display mode.

The above-referenced functionality, which is described in more detail herein, promotes situation awareness by allowing a pilot, with a single glance at an air traffic display, to quickly determine the relative and/or absolute motion of nearby traffic. The integrated avionics system described herein may be utilized to determine maneuvers required to maintain a certain distance from an air traffic target. In implementations, the distance maintained from an air traffic target, which may be automatically determined or selected by a user, may be specified by a user or determined based on the various criteria (e.g., the size of aircraft, the current velocity of the aircraft, a pilot-specified parameter, a predetermined default distance, etc.).

Moreover, in implementations, the techniques described herein may be utilized to promote situational awareness during in-trail approach scenarios, traffic join-up scenarios, Civil Air Patrol (CAP) applications, Search and Rescue (SAR) applications, and in situations where it is desirable to monitor separation while on approach with dissimilar categories of aircraft.

Example Environment

FIG. 1 illustrates an environment in an example implementation that includes an integrated avionics system 100 configured to provide an air traffic display in accordance with various techniques of the present disclosure. The integrated avionics system 100 may include one or more primary flight displays (PFDs) 102, and/or one or more multifunction displays (MFD) 104.

For instance, in the implementation illustrated in FIG. 1, the integrated avionics system 100 may be configured for use in an aircraft that is flown by a flight crew having two pilots (e.g., a pilot and a co-pilot). In this implementation, the integrated avionics system 100 may include a first PFD 102(1), a second PFD 102(2), and an MFD 104 that are mounted in the aircraft's instrument panel. As shown, the MFD 104 is mounted generally in the center of the instrument panel so that it may be accessed by either pilot (e.g., by either the pilot or the copilot). The first PFD 102(1) is mounted in the instrument panel generally to the left of the MFD 104 for viewing and access by the pilot. Similarly, the second PFD 102(2) is mounted in the instrument panel generally to the right of the MFD 104 for viewing and access by the aircraft's copilot or other crew member or passenger.

The PFDs 102 may be configured to display primary flight information, such as aircraft attitude, altitude, heading, vertical speed, and so forth. In implementations, the PFDs 102 may display primary flight information via a graphical representation of basic flight instruments such as an attitude indicator, an airspeed indicator, an altimeter, a heading indicator, a course deviation indicator, and so forth. The PFDs 102 may also display other information providing situational awareness to the pilot such as terrain information and ground proximity warning information.

As shown in FIG. 1, primary flight information may be generated by one or more flight sensor data sources including, for example, one or more attitude, heading, angular rate, and/or acceleration information sources such as attitude and heading reference systems (AHRSs) 106, one or more air data information sources such as air data computers (ADCs) 108, and/or one or more angle of attack information sources. For instance, in one implementation, the AHRSs 106 may be configured to provide information such as attitude, rate of turn, slip and skid; while the ADCs 108 may be configured to provide information including airspeed, altitude, vertical speed, and outside air temperature. Other configurations are possible.

Figure 2:
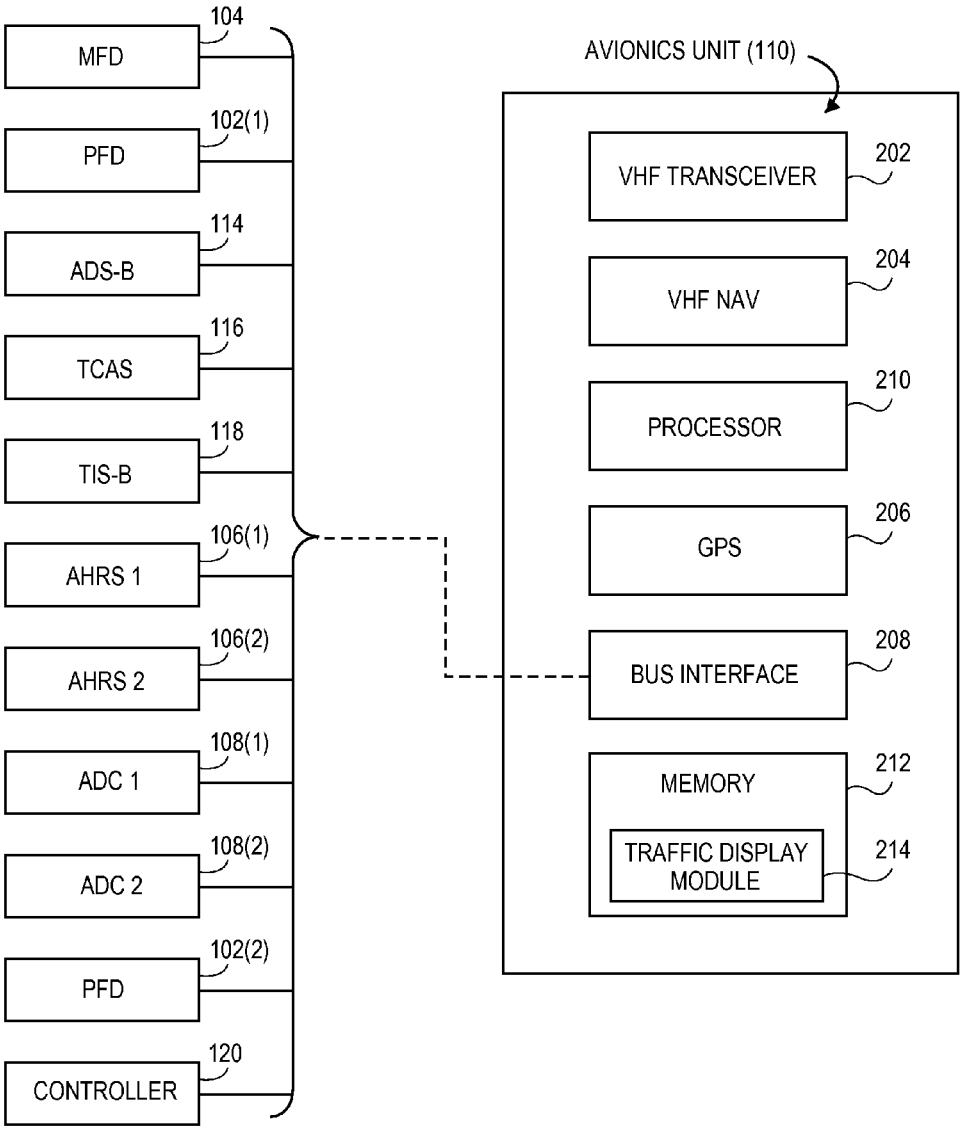
FIG. 2 is a block diagram illustrating an avionics unit of the integrated avionics system shown in FIG. 1, wherein the avionics unit is configured to cause an air traffic display displayed by a display device of the integrated avionics system to display the motion of air traffic targets relative to the aircraft.

One or more avionics units 110 (e.g., a single integrated avionics unit (IAU) is illustrated) may aggregate the primary flight information from the AHRSs 106 and ADCs 108 and provide the information to the PFDs 102 via an avionics data bus 112. The avionics unit 110 may also function as a combined communications and navigation radio. For example, as shown in FIG. 2, the avionics unit 110 may include a two-way Very High Frequency (VHF) communications transceiver 202, a VHF navigation receiver with glide slope 204, a global navigation satellite system (GNSS) receiver such as a global positioning system (GPS) receiver 206, or the like, an avionics data bus interface 208, a processor 210, a memory 212 including a traffic display module 214, and so forth.

The processor 210 provides processing functionality for the avionics unit 110 and may include any number of processors, micro-controllers, or other processing systems and resident or external memory for storing data and other information accessed or generated by the avionics unit 110. The processor 210 may execute one or more software programs which implement techniques described herein. The processor 210 is not limited by the materials from which it is formed or the processing mechanisms employed therein, and as such, may be implemented via semiconductor(s) and/or transistors (e.g., electronic integrated circuits (ICs)), and so forth.

The memory 212 is an example of computer-readable media that provides storage functionality to store various data associated with the operation of the avionics unit 110, such as the software programs and code segments mentioned above, or other data to instruct the processor 210 and other elements of the avionics unit 110 to perform the functionality described herein. Although a single memory 212 is shown, a wide variety of types and combinations of memory may be employed. The memory 212 may be integral with the processor 210, stand-alone memory, or a combination of both. The memory 212 may include, for example, removable and non-removable memory elements such as RAM, ROM, Flash (e.g., SD Card, mini-SD card, micro-SD Card), magnetic, optical, USB memory devices, and so forth.

The avionics data bus interface 208 furnishes functionality to enable the avionics unit 110 to communicate with one or more avionics data buses such as the avionics data bus 112. In various implementations, the avionics data bus interface 208 may include a variety of components, such as processors, memory, encoders, decoders, and so forth, and any associated software employed by these components (e.g., drivers, configuration software, etc.).

As shown in FIG. 1, the integrated avionics unit 110 may be paired with a primary flight display (PFD) 102, which may function as a controlling unit for the integrated avionics unit 110. In implementations, the avionics data bus 112 may comprise a high speed data bus (HSDB), such as data bus complying with ARINC 429 data bus standard promulgated by the Airlines Electronic Engineering Committee (AEEC), a MIL-STD-1553 compliant data bus, and so forth.

The MFD 104 displays information describing operation of the aircraft such as navigation routes, moving maps, engine gauges, weather radar, ground proximity warning system (GPWS) warnings, traffic collision avoidance system (TCAS) warnings, airport information, and so forth, that are received from a variety of aircraft systems via the avionics data bus 112. Information displayed on MFD 104 may be displayed on a PFD 102 and that the information displayed on a PFD 102 may be displayed on MFD 104. In embodiments, the integrated avionics system 100 may include only a single display device (e.g., a PFD 102 or a MFD 104).

In implementations, the integrated avionics system 100 employs redundant sources of primary flight information to assure the availability of the information to the pilot, and to allow for cross-checking of the sources of the information. For example, the integrated avionics system 100 illustrated in FIG. 1 employs two PFDs 102 that may receive primary flight information from redundant AHRSs 106 and ADCs 108, via the avionics unit 110. The integrated avionics system 100 is configured so that the first PFD 102(1) receives a first set of primary flight information aggregated by the avionics unit 110 from a first AHRS 106(1) and ADC 108(1). Similarly, the second PFD 102(2) receives a second set of primary flight information aggregated by the avionics unit 110 from a second AHRS 106(2) and ADC 108(2). Additionally, although a single avionics unit 110 and a single avionics data bus 112 are illustrated in FIG. 1, it is contemplated that redundant IAU's and/or redundant data buses may be employed for communication between the various components of the integrated avionics system 100.

In implementations, primary flight information provided by either the first AHRS 106(1) and ADC 108(1) or the second AHRS 106(2) and ADC 108(2) may be displayed on either PFD 102(1) or 102(2), or on the MFD 104 upon determining that the primary flight information received from either AHRS 106 and ADC 108 is in error or unavailable. One or both of the PFDs 102 may also be configured to display information shown on the MFD 104 (e.g., engine gauges and navigational information), such as in the event of a failure of the MFD 104.

The integrated avionics system 100 may employ cross-checking of the primary flight information (e.g., attitude information, altitude information, etc.) to determine if the primary flight information to be furnished to either of the PFDs 102 is incorrect. In implementations, cross-checking may be accomplished through software-based automatic continual comparison of the primary flight information provided by the AHRS 106 and ADC 108. In this manner, a "miss-compare" condition can be explicitly and proactively annunciated to warn the pilot when attitude information displayed by either PFD 102 sufficiently disagrees.

The first PFD 102(1), the second PFD 102(2), and/or the MFD 104 may receive additional data aggregated by the avionics unit 110 from a one or more of a plurality of systems communicatively coupled with the avionics unit 110. For example, the avionics unit 110 may be communicatively coupled with and may aggregate data received from one or more of: an Automatic Dependent Surveillance-Broadcast (ADS-B) system 114, Traffic Collision Avoidance System (TCAS) 116, and a Traffic Information Services-Broadcast (TIS-B) system 118.

One or more of the displays PFD 102(1), PFD 102(2), MFD 104 of the integrated avionics system 100 may be one of: an LCD (Liquid Crystal Diode) display, a TFT (Thin Film Transistor) LCD display, an LEP (Light Emitting Polymer or PLED (Polymer Light Emitting Diode) display, a cathode ray tube (CRT) and so forth, capable of displaying text and graphical information. Further, one or more of the displays PFD 102(1), PFD 102(2), MFD 104 may be backlit via a backlight such that it may be viewed in the dark or other low-light environments.

The integrated avionics system 100 may include a controller 120 which communicates with the avionics data bus 112. The controller 120 may provide a user interface (e.g., a touch interface) for the pilot for controlling the functions of one or more of the displays PFD 102(1), PFD 102(2), MFD 104 and for inputting information, such as navigational data, into the integrated avionics system 100. The avionics unit 110 may be configured for aggregating data and/or operating in an operating mode selected from a plurality of user-selectable operating modes based upon inputs provided via the controller 120.

The avionics unit 110 may be configured to generate an air traffic display based upon the data that it receives and aggregates from the various systems, such as the ADS-B system 114 and the TCAS 116. The air traffic display may depict air traffic within a monitored airspace surrounding the aircraft. For example, the avionics unit 110 is illustrated as including a traffic display module 214 which is storable in memory 212 and executable by the processor 210. The traffic display module 214 is representative of mode of operation selection and control functionality to access the received data (e.g., air traffic data) and generate an air traffic display based upon the received and aggregated data. The generated air traffic display may then be provided to and displayed by one or more of the display device(s) (e.g., PFD 102(1), PFD 102(2), or MFD 104).

Figure 3:
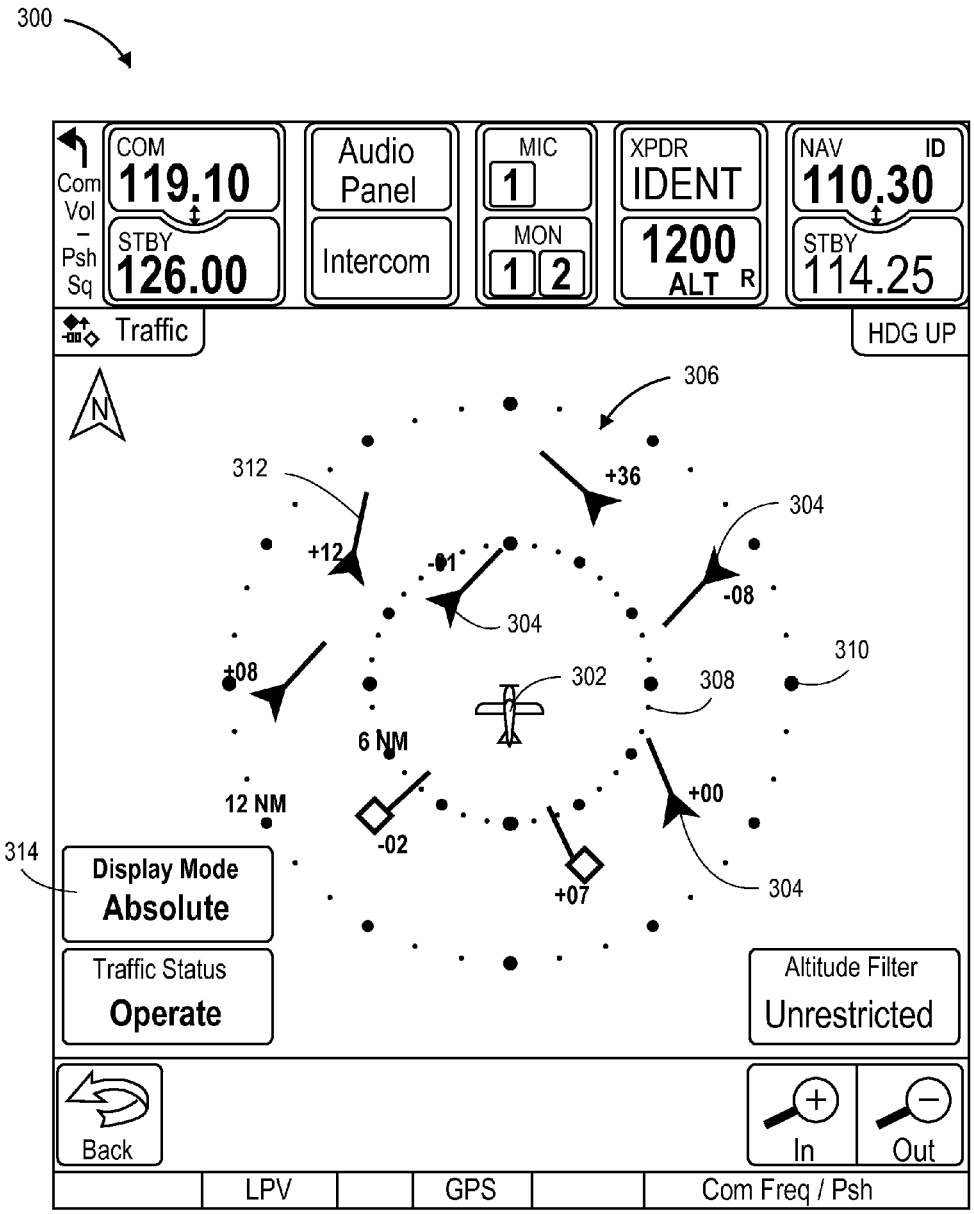
FIG. 3 is an illustration depicting an example air traffic display, wherein the air traffic display has been configured to display graphical indicators depicting absolute motion of a plurality of aircraft within a monitored airspace in accordance with an example implementation of the present disclosure.
Figure 4:
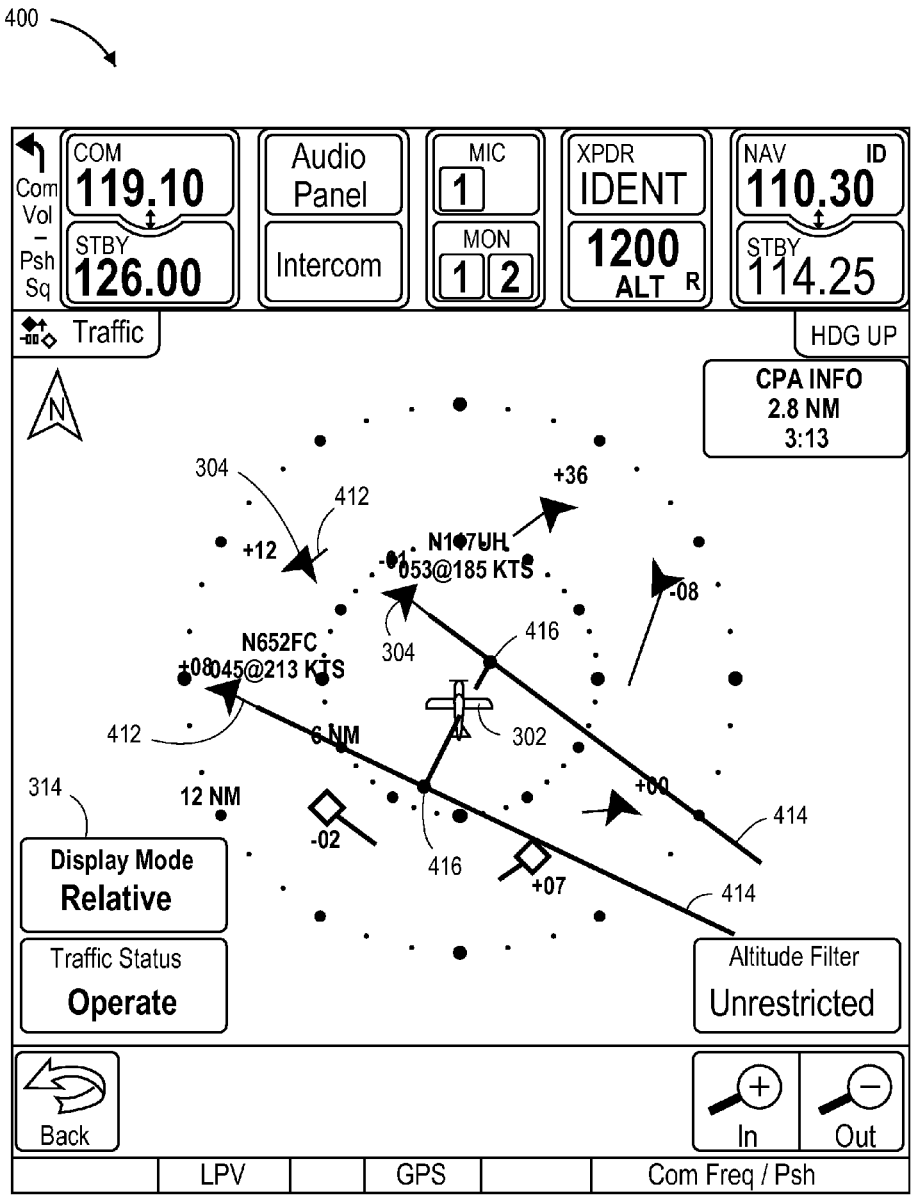
FIG. 4 is an illustration depicting an example air traffic display, wherein the air traffic display has been configured to display graphical indicators depicting relative motion of the plurality of aircraft within the monitored airspace in accordance with an example implementation of the present disclosure.
Figure 5:
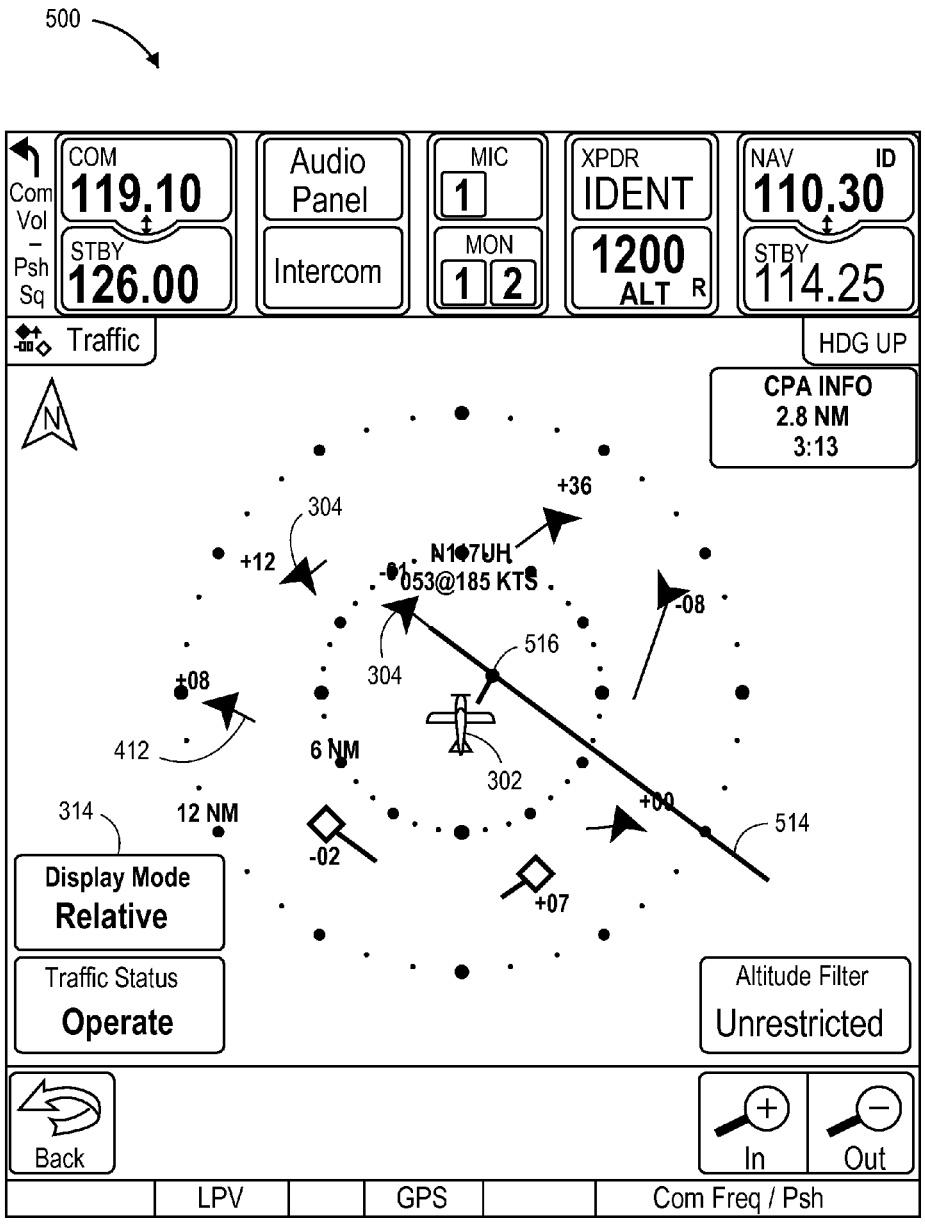
FIG. 5 is an illustration depicting the example air traffic display shown in FIG. 4, wherein the air traffic display has further been configured to display a graphical indicator depicting an estimated closest point of approach (CPA) of an aircraft within the monitored airspace in accordance with an example implementation of the present disclosure.

Examples of the displayed, generated air traffic displays (e.g., screenshots of the air traffic displays) are shown in FIGS. 3, 4, and 5. The air traffic displays may provide graphical depictions of air traffic that is located within a monitored airspace proximal to the aircraft in which the integrated avionics system 100 is implemented (e.g., in a three dimensional vicinity surrounding the aircraft, which may be pre-determined or selectable by a flight crew member). For instance, in FIGS. 3, 4 and 5, air traffic displays 300, 400, and 500 provide a graphical (e.g., iconic) representation of the aircraft (e.g., the flight crew's ownship) 302 as a fixed central reference or focal point, while also showing graphical and/or iconic representations of other aircraft (e.g., air traffic targets) 304 located within a monitored airspace 306 (e.g., monitored airspace surrounding the aircraft 302). In the implementations shown, the monitored airspace 306 covers up to a 12 nautical mile radius around the aircraft 302. However, a larger or smaller monitoring area (e.g., the area covered by the monitored airspace) may be determined or selected to monitor a larger or smaller area as desired. Further, the air traffic displays 300, 400, 500 provide boundary markers (e.g., concentric rings 308, 310) for demarcating sub-zones within the monitored airspace. For instance, in FIGS. 3, 4, and 5, concentric rings 308, 310 are provided to demarcate a 6 nautical mile radius and a 12 nautical mile radius, respectively, around the aircraft 302.

As mentioned above, the avionics unit 110 may be configured to aggregate data and/or operate in an operating mode (e.g., display mode) selected from a plurality of operator-selectable operating modes based upon inputs provided via the controller 120. For example, the avionics unit 110 may be placed into a first operating mode via the provided input(s). In embodiments the first operating mode is an absolute display mode, in which the avionics unit 110 aggregates data and provides an air traffic display comprised of a software-generated depiction to the display device(s) (e.g., PFD 102(1), PFD 102(2), or MFD 104) which, when displayed, depicts absolute motion of air traffic within the monitored airspace 306 proximate to the aircraft 302.

FIG. 3 illustrates an air traffic display 300 in which graphical depictions (e.g., absolute motion lines or vectors) 312 illustrating the absolute motion of air traffic targets (e.g., other aircraft) 304 within the monitored vicinity or airspace 306 of the aircraft 302 is shown. Absolute motion may be defined as motion relative to a fixed point on the earth's surface or relative to an apparently fixed celestial point.

Figure 6:
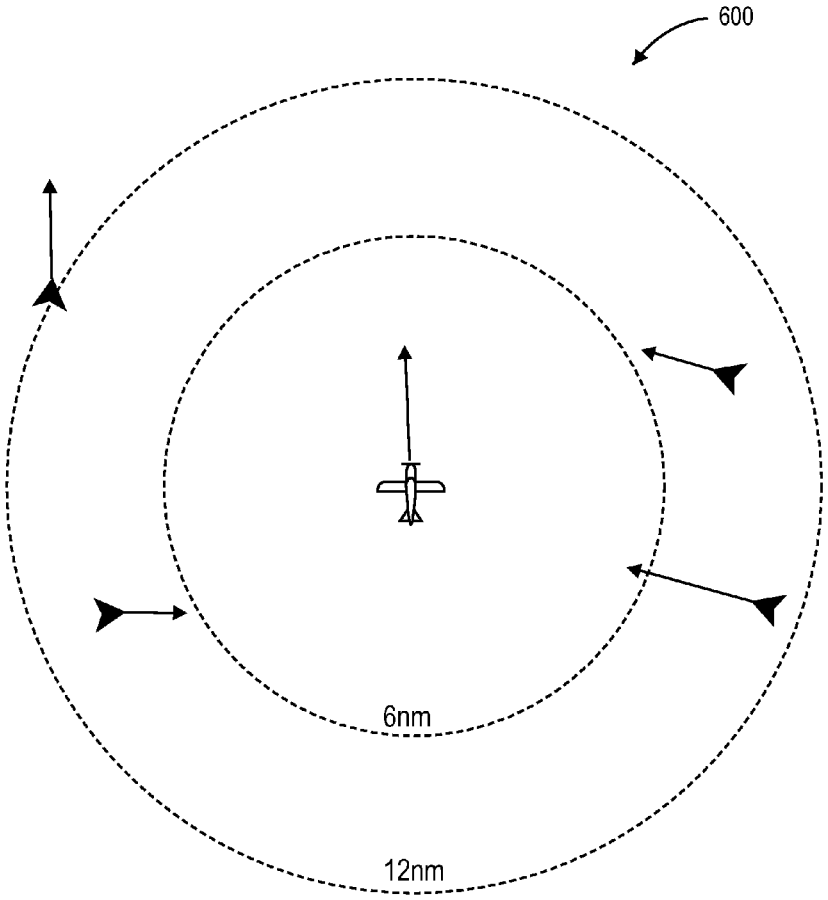
FIGS. 6 and 7 are diagrams illustrating absolute motion and relative motion, respectively, of aircraft and air traffic targets within a monitored airspace.

FIG. 6 illustrates an example depiction 600 of absolute motion for a set of aircraft. In FIG. 6, a centrally-located aircraft is depicted along with a plurality of air traffic targets in an air traffic zone, with the air traffic targets generally shown as surrounding the aircraft. Directional vectors for the aircraft and each of the air traffic targets are provided in FIG. 6 in order to illustrate the absolute motion of the air traffic targets and the aircraft (e.g., the motion of both the air traffic targets and the aircraft relative to a fixed point on the earth's surface or relative to an apparently fixed celestial point). In embodiments, the absolute motion of an air traffic target may include the current position of the air traffic target and an indication of an expected travel path (e.g., absolute motion lines or vectors) determined from a current direction of travel (e.g., heading) and speed. CPA for one or more of the target aircraft may be displayed along with target aircraft position and vector.

In another example, the avionics unit 110 may be switched out of the first operating mode and/or placed into a second operating mode included in the plurality of user-selectable operating modes, the second operating mode being a relative display mode. In some configurations, the avionics unit 110 may automatically toggle between the first and second operating modes. In other configurations, the operating modes may be directed switched by the crew or switched by the avionics unit 110 in response to a crew input. In second operating mode (relative display mode), the avionics unit 110 aggregates data and provides an air traffic display comprised of a software-generated depiction to one or more display device(s) (e.g., PFD 102(1), PFD 102(2), or MFD 104) which, when displayed, depicts relative motion of air traffic within the monitored airspace 306 of the aircraft 302 (e.g., relative motion of the other aircraft with respect to the aircraft 302). In some embodiments, the avionics unit may be configured to cause the air traffic display in a first operating mode and a second operating mode to be simultaneously displayed on one or more display devices.

FIGS. 4 and 5 illustrate air traffic displays 400, 500 in which graphical depictions (e.g., relative motion lines or vectors) 412 are shown illustrating relative motion of the air traffic targets (e.g., other aircraft) 304 within the monitored airspace 306 (e.g., vicinity, area) with respect to the aircraft 302. Relative motion may be defined as the movement of one or more contacts (e.g., air traffic targets 304) with respect to the aircraft (e.g., the aircraft 302).

Figure 7:
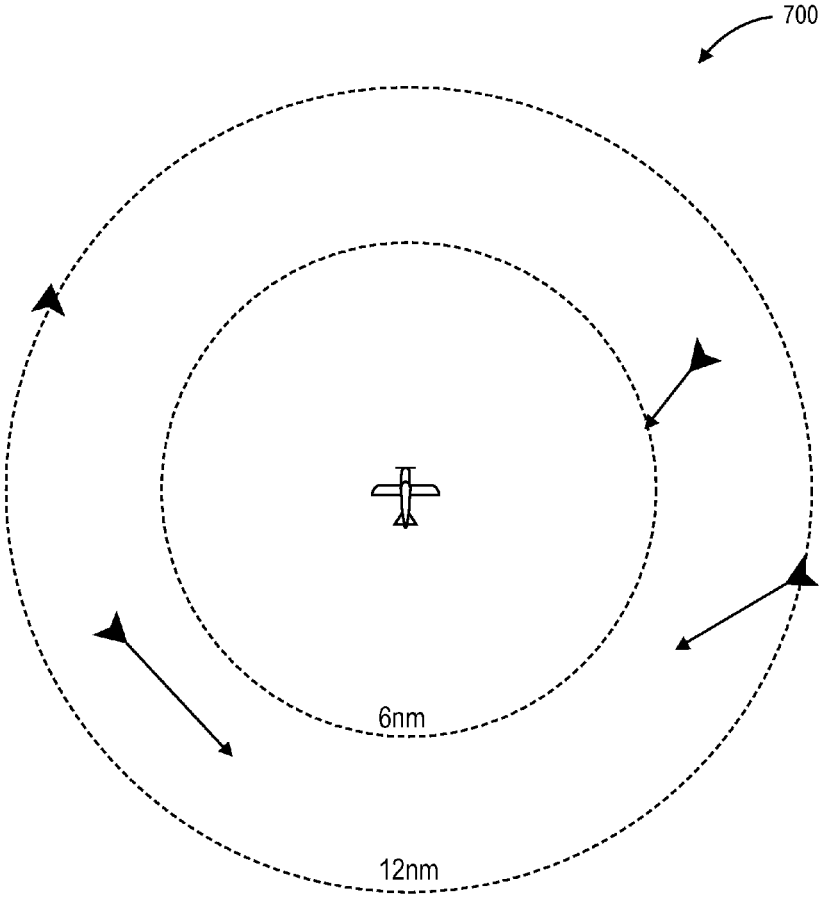

FIG. 7 illustrates, for the air traffic targets and the aircraft having the absolute motion profiles shown in FIG. 6, an example view 700 of the corresponding relative motion for those air traffic targets with respect to the centrally-depicted reference aircraft. Directional vectors for each of the air traffic targets provided in FIG. 7 illustrate the relative motion of the air traffic targets relative to the aircraft (e.g., the motion of the air traffic targets relative to the aircraft).

Air traffic displays 400, 500 further include graphical representations of projected (e.g., estimated future) motion path(s) of one or more of the air traffic targets 304 relative to the aircraft 302 based upon the current determined speeds (e.g., velocities) and directions of travel (e.g., heading) of the air traffic target(s) 304 and the aircraft 302. Projecting the future movement and proximity of two objects (e.g., aircraft) may involve the assumption that the current velocity and direction of travel of both objects will remain constant. In embodiments, the projected motion path may be based on the current velocity and direction of travel and a historical velocity and direction of travel. For example, if the speed of aircraft 302 or air traffic target(s) 304 is changing (e.g., increasing or decreasing), the protected motion path may include an assumption that the rate of speed change will continue for a period of time or anticipated speed. In embodiments, the protected motion path may be based on geographic data such as airports, no-fly zones, flight plans, and other location information that may impact the path of travel of an aircraft.

Further, the air traffic displays 400, 500 may provide graphical representations of a projected or estimated closest point(s) of approach (CPA) for one or more of the air traffic targets (e.g., other aircraft) 304 relative to the aircraft 302. As shown in FIGS. 4 and 5, projected path lines or vectors 414, 514 may be extrapolated (e.g., may extend) from relative motion lines 412 to determine and show projected future paths of the air traffic targets (e.g., other aircraft) 304. Further, the air traffic displays 400, 500 illustrated in FIGS. 4 and 5 may also show points or locations 416, 516 within the monitored airspace 306 where CPAs are estimated to occur.

In embodiments, projected path lines 414 and estimated CPA locations 416 may be indicated for air traffic targets 304 which are located within a nearer sub-zone 308 and also, for air traffic targets 304 located within a more distant sub-zone 310 of the monitored airspace 306 relative to the aircraft 302. In one mode, as shown in FIG. 4, estimated CPA locations 416 are within nearer sub-zone 308 with varying distances within the nearer sub-zone 308. In another mode, as shown in FIG. 5, projected path lines 514 and estimated CPA locations 516 may instead just be shown for aircraft within a nearer sub-zone 308 relative to the aircraft 302 that is determined to pose a higher risk of collision.

The air traffic displays 300, 400, 500 may provide graphical (e.g., iconic and/or textual) indicators indicating the operational mode (e.g., display mode) which is currently activated. These operational (display) mode indicators may be provided in the form of a display mode text box 314 as shown. Further, as shown in FIGS. 4 and 5, aircraft data indicators for the air traffic targets 304 may be provided in the form of textual information listed next to the air traffic target (other aircraft) 304 icons in the air traffic displays 400, 500 and may provide data such as: callsign or identifier of an air traffic target 304, ground speed of an air traffic target 304, track data of the air traffic target 304, and any other information associated with the air traffic target 304.

In one or more implementations, the avionics unit 110 may be switched out of the first or second operating modes and/or placed into a further operating mode included in the plurality of user-selectable operating modes, the further operating mode being a selected aircraft profile display mode. In a selected aircraft profile display mode, the avionics unit 110 aggregates data and provides a an air traffic display comprised of a software-generated depiction to the display device(s) (e.g., PFD 102(1), PFD 102(2), or MFD 104) which, when displayed, depicts detailed profile information from an air traffic target (e.g., another aircraft) 304 selected from one of the displayed air traffic displays 300, 400 or 500, such as those shown in FIGS. 3, 4, and 5. For example, from a displayed air traffic display 300, 400, 500, an operator (e.g., member of the aircraft's flight crew such as a pilot or copilot) may provide an input for selecting one of the displayed air traffic targets (e.g., other aircraft) 304 and requesting more detailed or additional profile information corresponding to the selected air traffic target 304. This input may, for example, be provided via touch input to the controller 120, a control (e.g., knob, button, etc.) within the integrated avionics system 100, and so forth. However, the profile information may be presented by any of the operating modes.

Figure 8:
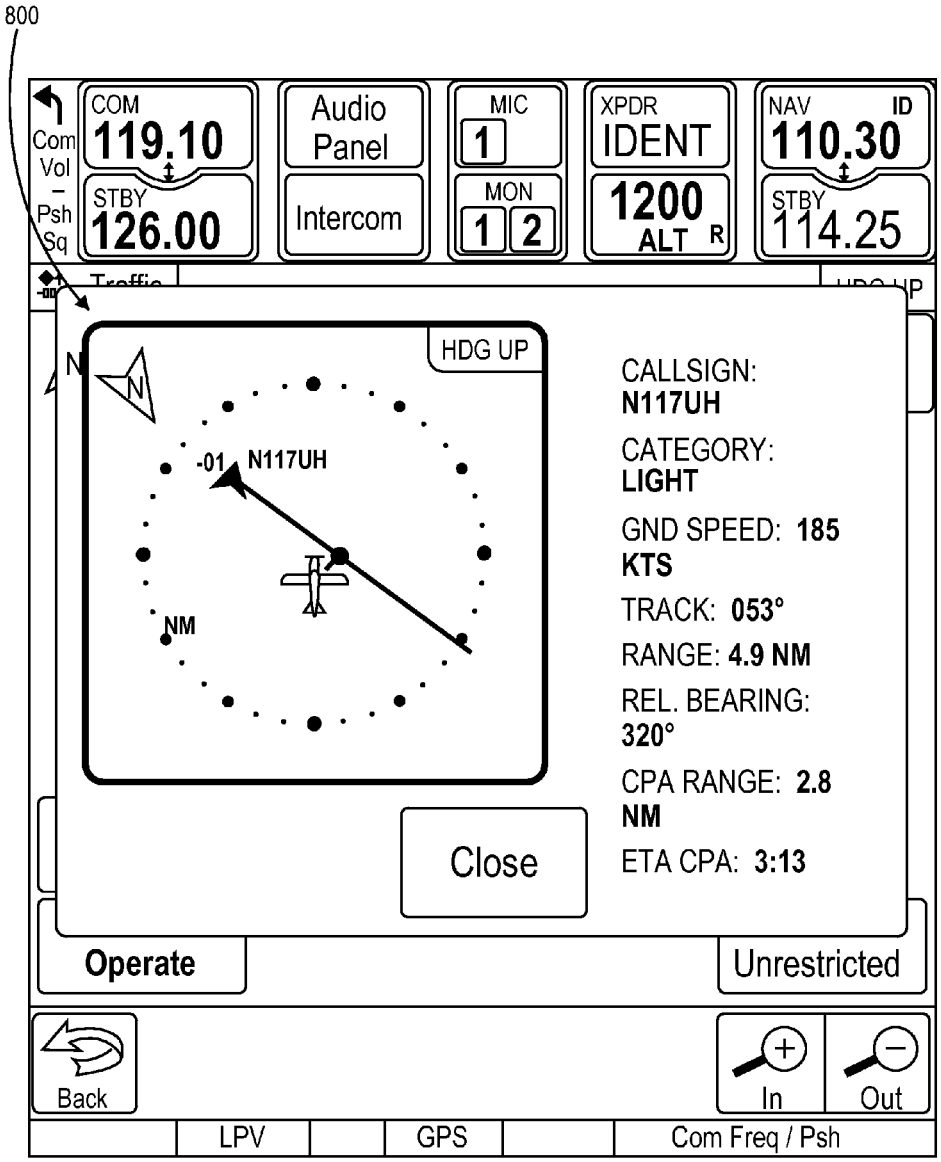
FIG. 8 is an illustration depicting a display that includes detailed profile information for an aircraft selected from the air traffic displays shown in FIGS. 4 and 5, in accordance with a further example implementation of the present disclosure.

FIG. 8 illustrates a display 800 in which detailed profile information (e.g., shown in a textual format) is depicted for a selected air traffic target 304. As shown, the detailed profile information may include, but is not limited to, the following data corresponding to the selected air traffic target 304: a callsign or identifier; a weight class category; a ground speed; track data; range data; relative bearing; a closest point of approach (CPA) range relative to the aircraft 302; and an estimated time of arrival to a CPA. The display 800 may be provided as an overlay window to one of air traffic displays 300, 400, 500, and may be closed (removed from display) via a second input.

The avionics unit 110 is configured for dynamically aggregating data and for providing air traffic display(s) comprised of dynamically-updated software-generated depictions to one or more display device(s) (e.g., PFD 102(1), PFD 102(2), or MFD 104) based upon the dynamically aggregated and updated data for the aircrew (e.g., pilot and/or copilot) of the aircraft 302 with a real-time view of traffic data within the monitored airspace 306 surrounding the aircraft 302.

Generally, any of the functions described herein can be implemented using software, firmware, hardware (e.g., fixed logic circuitry), manual processing, or a combination of these implementations. The terms "module" and "functionality" as used herein generally represent software, firmware, hardware, or a combination thereof. The communication between modules in the integrated avionics system 100 of FIG. 1 and/or the avionics unit 110 of FIG. 2 can be wired, wireless, or some combination thereof. In the case of a software implementation, for instance, the module represents executable instructions that perform specified tasks when executed on a processor, such as the processor 210 of the avionics unit 110 shown in FIG. 2. The program code can be stored in one or more storage media, an example of which is the memory 212 associated with the avionics unit 110 of FIG. 2. While an integrated avionics system 100 is described herein, by way of example, it is contemplated that, the functions described herein can also be implemented in one or more independent (stand-alone) avionics units or systems implemented within an aircraft, such as an aircraft that does not include an integrated avionics system.

Example Procedures

The following discussion describes procedures that allow an air traffic display of an aircraft to determine and display the relative motion and/or absolute motion of air traffic proximate to (e.g., within a monitored airspace around) the aircraft. For example, motion information (including closest point of approach (CPA) information) for air traffic relative to the aircraft may be provided to a display device and displayed within an air traffic display in a first display mode, and absolute motion of the air traffic may be provided to the display device and displayed within an air traffic display in a second display mode. Aspects of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to the integrated avionics system 100 of FIG. 1, the avionics unit 110 of FIG. 2, the air traffic displays of FIGS. 3, 4, and 5, and the display 800 of FIG. 8.

Figure 9:
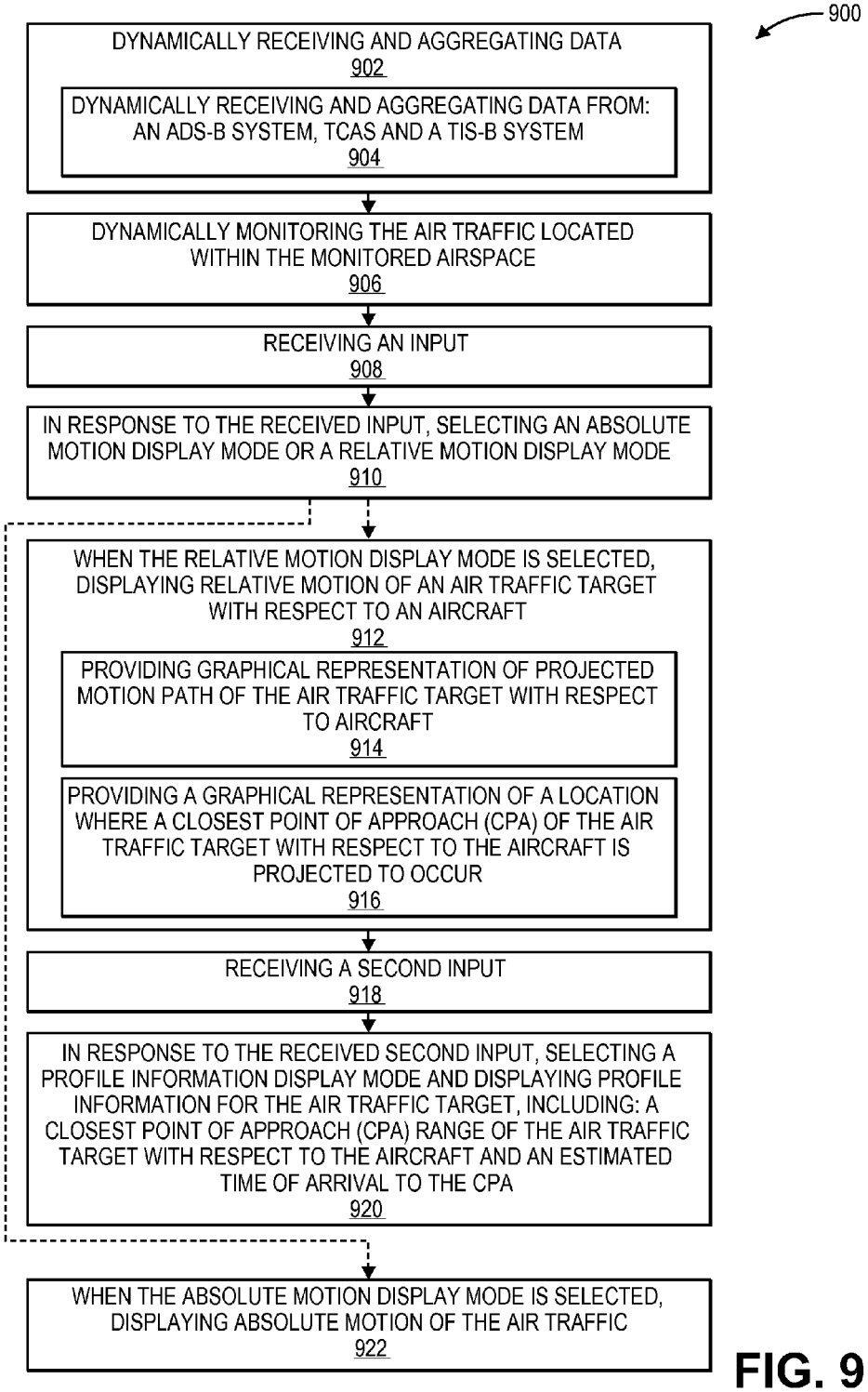
FIG. 9 is a flow diagram illustrating a process in an example implementation in which an air traffic display of an aircraft may be configured to display the relative motion and absolute motion of air traffic proximate to the aircraft.

FIG. 9 illustrates a procedure 900, in an example implementation, in which an integrated avionics system 100 implemented on-board an aircraft may be selectively switched between a first display mode in which absolute motion of air traffic targets is determined and displayed (e.g., motion of the air traffic targets relative to a fixed point on the earth's surface or relative to an apparently fixed celestial point is displayed) and a second display mode in which motion of air traffic targets relative to the aircraft is determined and displayed. The depicted air traffic targets are located within a monitored airspace surrounding the aircraft. As illustrated, the procedure 900 may include dynamically receiving and aggregating data (Block 902) describing both the location and velocity of air traffic targets (e.g., other aircraft) within the monitored airspace and the location and velocity of the aircraft. The term "air traffic" as used herein may include both an aircraft and air traffic targets in the monitored airspace surrounding the aircraft. For example, an avionics unit 110 (e.g., an integrated avionics unit (IAU) of an integrated avionics system 100) within the aircraft may dynamically receive and aggregate data from one or more systems, such as an ADS-B system 114, a TCAS 116, a GPS system 206, a controller 120, and/or a TIS-B system 118, and so forth (Block 904), which are communicatively coupled with the avionics unit 110 via an avionics data bus 112. Air traffic within a monitored vicinity of the aircraft is dynamically monitored (Block 906). For example, the avionics unit 110 dynamically monitors air traffic targets 304 located within the monitored airspace surrounding the aircraft 302 and also monitors the aircraft 302 based upon the dynamically received and aggregated data.

An input is then received (Block 908) to select one of a first display mode or a second display mode for the air traffic display. For example, the avionics unit 110 may receive a first input from a member of the flight crew (e.g., pilot and/or copilot) provided via a user interface, such as via a controller 120. The received input may also comprise a non-user (e.g., flight crew) provided input that is automatically provided by one or more components of the integrated avionics system 100. In response to the received input, one of: the first display mode (e.g., absolute motion display mode) or the second display mode (e.g., relative motion display mode) is selected (Block 910). For example, based upon the received input, the avionics unit 110 may then provide an air traffic display comprised of a software-generated depiction to one or more of the display device(s) (e.g., PFD 102(1), PFD 102(2), or MFD 104) implemented on-board the aircraft.

If the received input selects the second display mode to determine and/or display the relative motion display mode (Block 912), the avionics unit 110 may then provide an air traffic display comprised of a software-generated depiction to one or more of the display device(s) (e.g., PDF 102(1), PDF 102(2), or MFD 104). For example, the air traffic display(s) comprised of software-generated depictions 400, 500, such as shown in FIGS. 4 and 5, may provide a graphical indication of the motion of air traffic targets 304 relative to aircraft 302. The avionics unit 110 may determine the relative motion of the one or more air traffic targets or receive information providing the relative motion of air traffic targets within a monitored airspace surrounding the aircraft. The air traffic display(s) comprised of software-generated depictions 400, 500 may be generated by the avionics unit 110 based upon the data which was dynamically received and aggregated by the avionics unit 110. For example, motion of the air traffic targets 304 relative to aircraft 302 may be shown by relative motion indicators 412. Further, a graphical representation of a projected motion path(s) 414 of the air traffic targets 304 relative to aircraft 302 may be determined and shown, the projected motion path(s) being based upon positions, velocities and directions of travel (e.g., heading) of air traffic targets 304 and aircraft 302 (Block 914). Still further, a location 416 where a closest point of approach (CPA) of the air traffic targets 304 relative to aircraft 302 is projected to occur may also be determined and a graphical representation of the location 416 shown (Block 916).

If the received input selects the first display mode to determine and/or display the absolute motion display mode (Block 922), the avionics unit 110 may then provide an air traffic display comprised of a software-generated depiction to one or more of the display device(s) (e.g., PDF 102(1), PDF 102(2), or MFD 104). The air traffic display comprised of the software-generated depiction 300, such as shown in FIG. 3, may provide a graphical indication of absolute motion of the air traffic targets 304 and aircraft 302. The air traffic display comprised of the software-generated depiction 300 may be generated by the avionics unit 110 based upon the data which was dynamically received and aggregated by the avionics unit 110.

The avionics unit 110 may receive a second input (Block 918). For example, the avionics unit 110 may receive a second input provided by a member of the flight crew via a user interface, such as via a controller 120, or the second input may be automatically provided by one or more components of the integrated avionics system 100. Based upon the second received input, a profile information display mode is selected for causing the air traffic display to be configured for displaying profile information for the one or more air traffic targets, including providing a second air traffic display comprised of a second software-generated depiction (Block 920). For instance, the avionics unit 110 may then provide a second air traffic display comprised of a second software-generated depiction to one of the display device(s) (e.g., PFD 102(1), PFD 102(2), or MFD 104) implemented on-board the first aircraft. The second air traffic display comprised of the second software-generated depiction 800, such as shown in FIG. 8, may provide detailed profile information for the air traffic targets 304, including: a closest point of approach (CPA) range relative to aircraft 302, an estimated time of arrival to the CPA, a callsign, a weight class category, a ground speed, track data, range, and bearing. The second air traffic display comprised of the second software-generated depiction (800) may be generated by the avionics unit 110 based upon the data which was dynamically received and aggregated by the avionics unit 110.

CONCLUSION

Although the integrated avionics system 100 has been described with reference to example implementations illustrated in the attached drawing figures, it is noted that equivalents may be employed and substitutions made herein without departing from the scope of the invention as recited in the claims. Further, the integrated avionics system 100 and its components as illustrated and described herein are merely examples of a system and components that may be used to implement the present invention and may be replaced with other devices and components without departing from the scope of the present invention.

What is claimed is:

1. An integrated avionics system configured for implementation in an aircraft, the integrated avionics system comprising:

a display device configured to furnish an air traffic display depicting air traffic surrounding the aircraft; and an avionics unit communicatively coupled with the display device, the avionics unit including:

a memory operable to store one or more modules; and a processor coupled with the memory, the processor operable to execute the one or more modules to:

access traffic information corresponding to an air traffic target;

generate an air traffic target icon using the accessed traffic information, the target icon indicating the absolute heading of the air traffic target;

generate a relative motion vector using the accessed traffic information, the relative motion vector indicating the relative heading of the air traffic target with respect to the aircraft; and control the display to present the target icon and relative motion vector so that the relative motion vector extends from the target icon.

2. The system of claim 1, wherein the accessed traffic information is based upon dynamically received data from at least one of:

an Automatic Dependent Surveillance-Broadcast (ADS-B) system; a Traffic Collision Avoidance System (TCAS); and a Traffic Information Services-Broadcast (TIS-B) system.

3. The system of claim 1, wherein the processor is further configured to generate target icons and corresponding relative motion vectors for a plurality of air traffic targets.

4. The system of claim 1, wherein the target icon presents a chevron shape with the apex of the chevron indicating the absolute heading of the target.

5. The system of claim 4, wherein the relative motion vector is a line extending from the chevron.

6. The system of claim 1, wherein the display indicates the location of the aircraft in relation to the target icon.

7. The system of claim 1, further comprising an Automatic Dependent Surveillance-Broadcast (ADS-B) system.

8. An integrated avionics system configured for implementation in an aircraft, the integrated avionics system comprising:

a display device configured to furnish an air traffic display depicting air traffic surrounding the aircraft; and an avionics unit communicatively coupled with the display device, the avionics unit including:

a memory operable to store one or more modules; and a processor coupled with the memory, the processor operable to execute the one or more modules to:

access traffic information corresponding to an air traffic target;

generate an air traffic target icon using the accessed traffic information, the target icon comprising a chevron shape where the apex of the chevron indicates the absolute heading of the air traffic target;

generate a relative motion vector using the accessed traffic information, the relative motion vector indicating the relative heading of the air traffic target with respect to the aircraft; and control the display to present the target icon and relative motion vector so that the relative motion vector extends from the chevron-shaped target icon.

9. The system of claim 8, wherein the accessed traffic information is based upon dynamically received data from at least one of:

an Automatic Dependent Surveillance-Broadcast (ADS-B) system; a Traffic Collision Avoidance System (TCAS); and a Traffic Information Services-Broadcast (TIS-B) system.

10. The system of claim 8, wherein the display indicates the location of the aircraft in relation to the target icon.

11. A method for furnishing an air traffic display depicting air traffic within a monitored airspace surrounding an aircraft comprising:

dynamically receiving and aggregating air traffic information describing the location of at least one air traffic target within the monitored airspace;

generating an air traffic target icon using the traffic information, the target icon comprising a chevron shape where the apex of the chevron indicates the absolute heading of the air traffic target;

generating a relative motion vector using the accessed traffic information, the relative motion vector indicating the relative heading of the air traffic target with respect to the aircraft; and controlling a display to present the target icon and relative motion vector so that the relative motion vector extends from the chevron-shaped target icon.

12. The method as recited in claim 11, wherein the step of dynamically receiving and aggregating data comprises:

dynamically receiving and aggregating data from: an Automatic Dependent Surveillance-Broadcast (ADS-B) system; a Traffic Collision Avoidance System (TCAS); and a Traffic Information Services-Broadcast (TIS-B) system.

13. The method as recited in claim 11, further comprising controlling the display to indicate the location of the aircraft in relation to the target icon.

* * * * *